US010737513B2

(12) United States Patent
Takenaka et al.

(10) Patent No.: US 10,737,513 B2
(45) Date of Patent: Aug. 11, 2020

(54) LIQUID DISCHARGE APPARATUS

(71) Applicant: SEIKO EPSON CORPORATION, Tokyo (JP)

(72) Inventors: Ryota Takenaka, Matsumoto (JP); Mikio Kitagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/947,482

(22) Filed: Apr. 6, 2018

(65) Prior Publication Data

US 2018/0290464 A1 Oct. 11, 2018

(30) Foreign Application Priority Data

Apr. 7, 2017 (JP) ..... 2017-077026

(51) Int. Cl.

| | |
|---|---|
| ***B41J 11/00*** | (2006.01) |
| ***B41J 11/06*** | (2006.01) |
| ***B41J 11/08*** | (2006.01) |
| ***B41J 2/155*** | (2006.01) |
| ***B41J 11/22*** | (2006.01) |
| ***B41J 13/10*** | (2006.01) |

(52) U.S. Cl.

CPC ..... *B41J 11/08* (2013.01); *B41J 2/155* (2013.01); *B41J 11/0085* (2013.01); *B41J 11/06* (2013.01); *B41J 11/22* (2013.01); *B41J 13/106* (2013.01)

(58) Field of Classification Search

CPC ..... B41J 11/085; B41J 11/22; B41J 2/155

See application file for complete search history.

(56) References Cited

U.S. PATENT DOCUMENTS

| | | | | |
|---|---|---|---|---|
| 4,294,540 | A * | 10/1981 | Thettu | G03B 27/64 198/689.1 |
| 6,254,090 | B1 * | 7/2001 | Rhodes | B41J 11/0085 271/265.01 |
| 6,729,720 | B2 * | 5/2004 | Miki | B41J 11/0085 347/104 |
| 7,093,933 | B2 * | 8/2006 | Tsuji | B41J 11/0025 226/95 |
| 7,354,147 | B2 * | 4/2008 | Beehler | B41J 11/0085 347/101 |
| 8,646,902 | B2 * | 2/2014 | Toyoshima | B41J 11/0085 347/101 |
| 8,857,972 | B2 * | 10/2014 | Toyoshima | B41J 11/0025 347/101 |
| 2005/0095046 | A1 * | 5/2005 | Beehler | B41J 11/0085 400/23 |

FOREIGN PATENT DOCUMENTS

JP 2004-230839 A 8/2004

* cited by examiner

*Primary Examiner* — Kristal Feggins
*Assistant Examiner* — Kendrick X Liu
(74) *Attorney, Agent, or Firm* — Workman Nydegger

(57) ABSTRACT

There is provided a liquid discharge apparatus including: a discharge portion that discharges liquid to a medium to be transported in a transporting direction, and a supporting portion that has a supporting surface supporting the medium, in which the supporting surface does not have unevenness in a width direction intersecting the transporting direction, but has groove portions formed continuously along the width direction, and the groove portions are formed with suction holes which suck the medium.

6 Claims, 4 Drawing Sheets

LIQUID DISCHARGE APPARATUS

BACKGROUND

1. Technical Field

The present invention relates to a liquid discharge apparatus.

2. Related Art

In the related art, various liquid discharge apparatuses are used. Among the various liquid discharge apparatuses, there is a liquid discharge apparatus that supports a medium to be transported on a supporting surface of a supporting portion and discharges a liquid onto the medium supported on the supporting surface to form an image.

For example, JP-A-2004-230839 discloses an ink jet printer (liquid discharge apparatus) which supports a recording paper as a medium on a platen (supporting surface) and discharges ink as a liquid onto the recording paper supported on the recording platen.

In the liquid discharge apparatus in the related art that supports the medium to be transported on the supporting surface, there is a case where the medium is floated from the supporting surface and is in contact with a discharge portion of the liquid. JP-A-2004-230839 describes that a suction port is drilled in the surface of a platen and suction is performed by suction means, thereby bringing the recording paper into close contact with the platen.

However, the ink jet printer disclosed in JP-A-2004-230839 has unevenness on the surface of the platen facing the recording head (discharge portion) in a width direction (direction intersecting direction in which recording paper is transported) due to the presence of the suction port. Then, the ink is discharged onto the medium deformed corresponding to the unevenness, and a landing position of the ink is shifted according to the deformation of the medium caused by the unevenness, and thus there is a case where the image quality decreases.

SUMMARY

An advantage of some aspects of the invention is to suppress decrease in an image quality according to floatation of a medium to be transported from a supporting surface and deformation of the medium.

According to an aspect of the invention, there is provided a liquid discharge apparatus including: a discharge portion that discharges liquid to a medium to be transported in a transporting direction; and a supporting portion that has a supporting surface supporting the medium, in which the supporting surface does not have unevenness in a width direction intersecting the transporting direction, but has a groove portion formed continuously along the width direction, and the groove portion is formed with a suction hole which sucks the medium.

Here, "does not have unevenness" is not limited to the fact that the supporting surface is strictly flat in the width direction, but is used in a meaning that it is a surface shape enough to say that there is no substantial influence on image quality even if the medium is deformed by own weight thereof or external force such as suction force on the supporting surface.

In this configuration, since the liquid discharge apparatus has the supporting surface that does not have the unevenness in the width direction and has the groove portion which is formed with the suction hole for sucking the medium and continuously formed along the width direction, the medium can be kept flat by supporting the medium with a supporting surface having no unevenness in the width direction while suppressing floatation of the medium from the supporting surface by the suction hole of the groove portion. Therefore, the floatation of the medium to be transported from the supporting surface and the decrease in the image quality due to the deformation of the medium can be suppressed.

In the liquid discharge apparatus, the length of the groove portion in the width direction may be longer than the length of a maximum width medium in the width direction, the maximum width medium is the medium that has the maximum length in the width direction among media that can be supported by the supporting portion.

In this configuration, since the length of the groove portion in the width direction is longer than the length of the maximum width medium in the width direction, even if any medium that can be supported by the supporting portion is used, the floatation of the medium from the supporting surface can be reliably suppressed.

In the liquid discharge apparatus, the groove portion may be formed continuously from an end portion on one side of the supporting surface to an end portion on the other side of the supporting surface in the width direction.

In this configuration, since the groove portion are continuously formed from the end portion on one side of the supporting surface to the end portion on the other side of the supporting surface in the width direction, the floatation of the medium from the supporting surface can be suppressed particularly reliably.

In the liquid discharge apparatus, the groove portion may include a first groove portion and a second groove portion which is provided on a downstream side of the first groove portion in the transporting direction.

In this configuration, since the plurality of groove portions including the first groove portion and the second groove portion are provided, the floatation of the medium from the supporting surface can be reliably suppressed.

In the liquid discharge apparatus, the supporting surface may support the medium at least in a discharge range that is a range discharging the liquid by the discharge portion, a position of the second groove portion in the transporting direction may be closer to the center of the discharge range in the transporting direction than the position of the first groove portion in the transporting direction is, and a flow rate of air that can be sucked in the second groove portion may be higher than a flow rate of air that can be sucked in the first groove portion.

By making the flow rate of the air higher, the medium can be particularly strongly sucked. Although the medium is likely to be bulged and floated by liquid discharged from the discharge portion being landed, in this configuration, since the medium can be strongly sucked in the vicinity of the center of the discharge range in the transporting direction, the floatation of the medium from the supporting surface can be effectively suppressed.

In the liquid discharge apparatus, the supporting surface may support the medium at least in the discharge range that is a range discharging the liquid by the discharge portion, a position of the second groove portion in the transporting direction may be closer to the center of the discharge range in the transporting direction than the position of the first groove portion in the transporting direction is, and the number of the suction hole formed in the second groove portion may be more than the number of the suction hole formed in the first groove portion.

By making the number of suction holes more, it is easy to suck the medium particularly strongly. Although the medium is likely to be bulged and floated by the liquid discharged from the discharge portion being landed, in this configuration, since it becomes easy to strongly suck the medium near the center of the discharge range in the transporting direction, the floatation of the medium from the supporting surface can be suppressed easily and effectively.

In addition, by making the number of suction holes more, since it is easy to locally suck the medium, in this configuration, by locally sucking the medium near the center of the discharge range in the transporting direction, floatation of the medium from the supporting surface can be suppressed easily and effectively.

In the liquid discharge apparatus, the supporting surface may support the medium at least in the discharge range which is a range discharging the liquid by the discharge portion, a position of the second groove portion in the transporting direction may be closer to the center of the discharge range in the transporting direction than the position of the first groove portion in the transporting direction is, and the size of the suction hole formed in the second groove portion may be smaller than the size of the suction hole formed in the first groove portion.

By making the size of the suction holes smaller, it is easy to make the number of suction holes more, and it is easy to locally suck the medium. Although the medium is likely to be bulged and floated by the liquid discharged from the discharge portion being landed, in this configuration, since it becomes easy to locally suck the medium near the center of the discharge range in the transporting direction, floatation of the medium from the supporting surface can be suppressed easily and effectively.

In the liquid discharge apparatus, the groove portion may further include a third groove portion which is provided on the downstream side of the second groove portion in the transporting direction.

In this configuration, since the plurality of groove portions including the first groove portion, the second groove portion, and the third groove portion are provided, floatation of the medium from the supporting surface can be reliably suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus as a liquid discharge apparatus according to an example of the invention will be described in detail with reference to the accompanying drawings.

Figure 1:
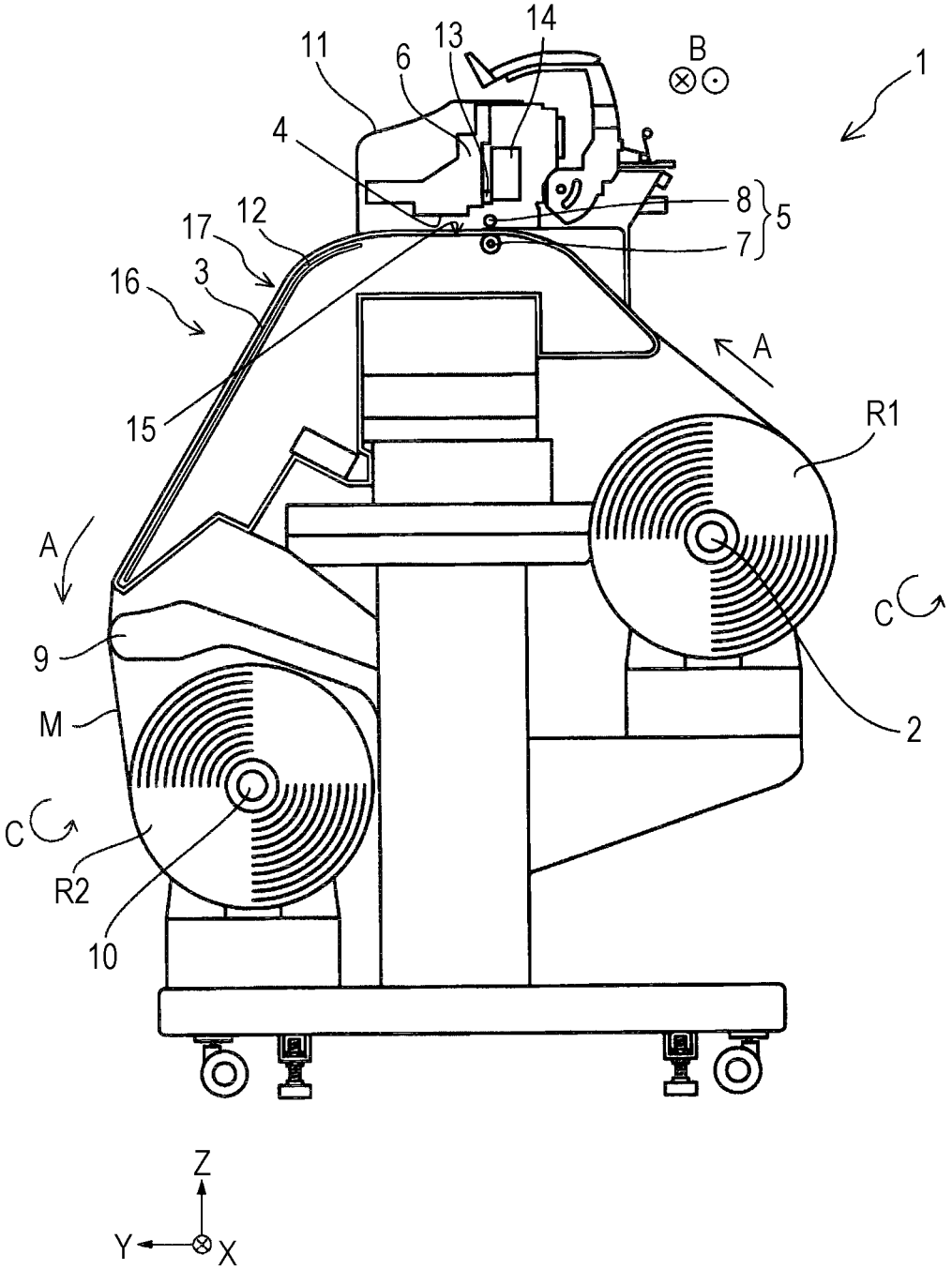
FIG. 1 is a schematic side view illustrating a printing apparatus according to Example 1 of the invention.
Figure 2:
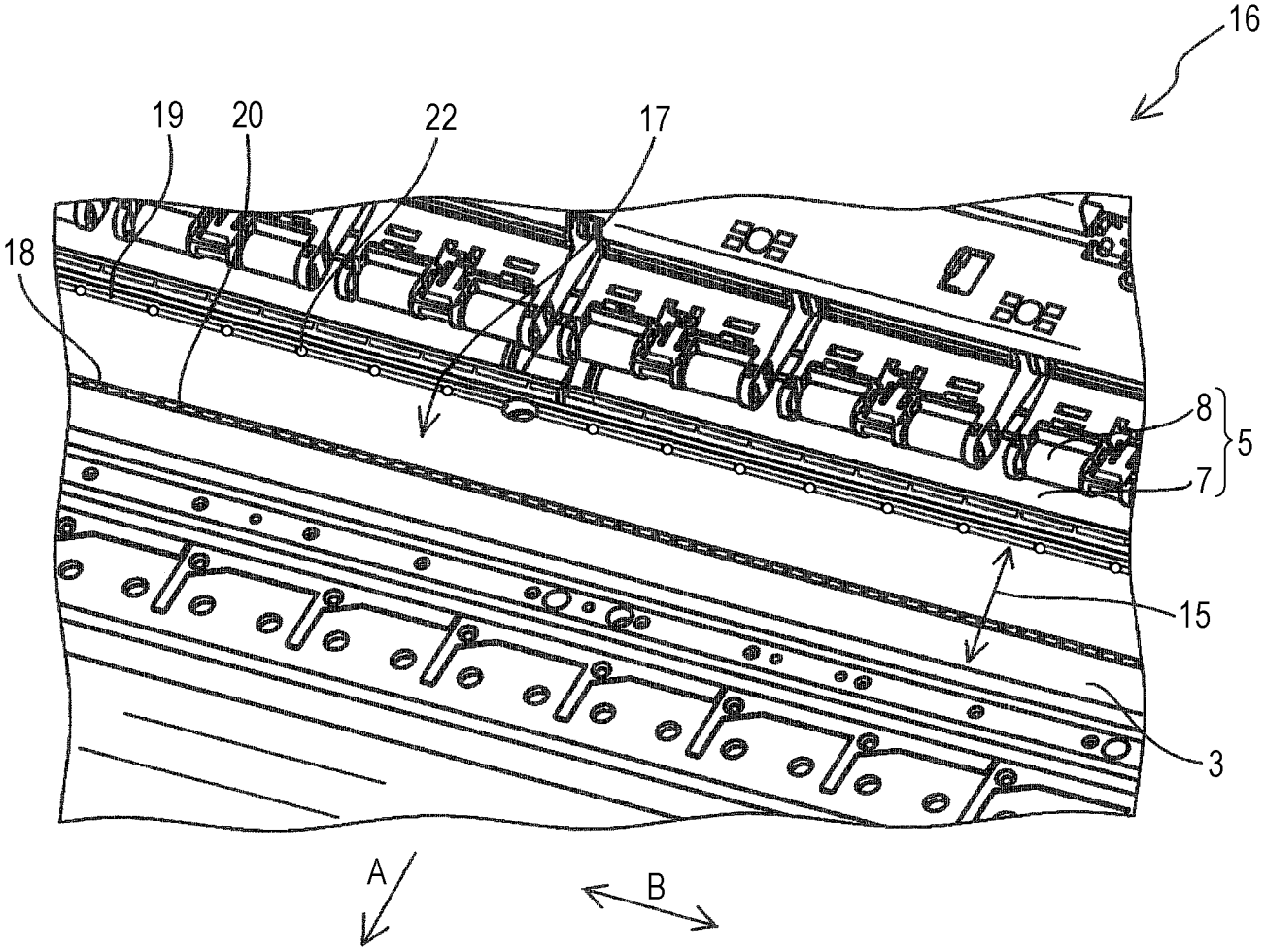
FIG. 2 is a perspective view illustrating a main portion of the printing apparatus according to Example 1 of the invention.
Figure 3:
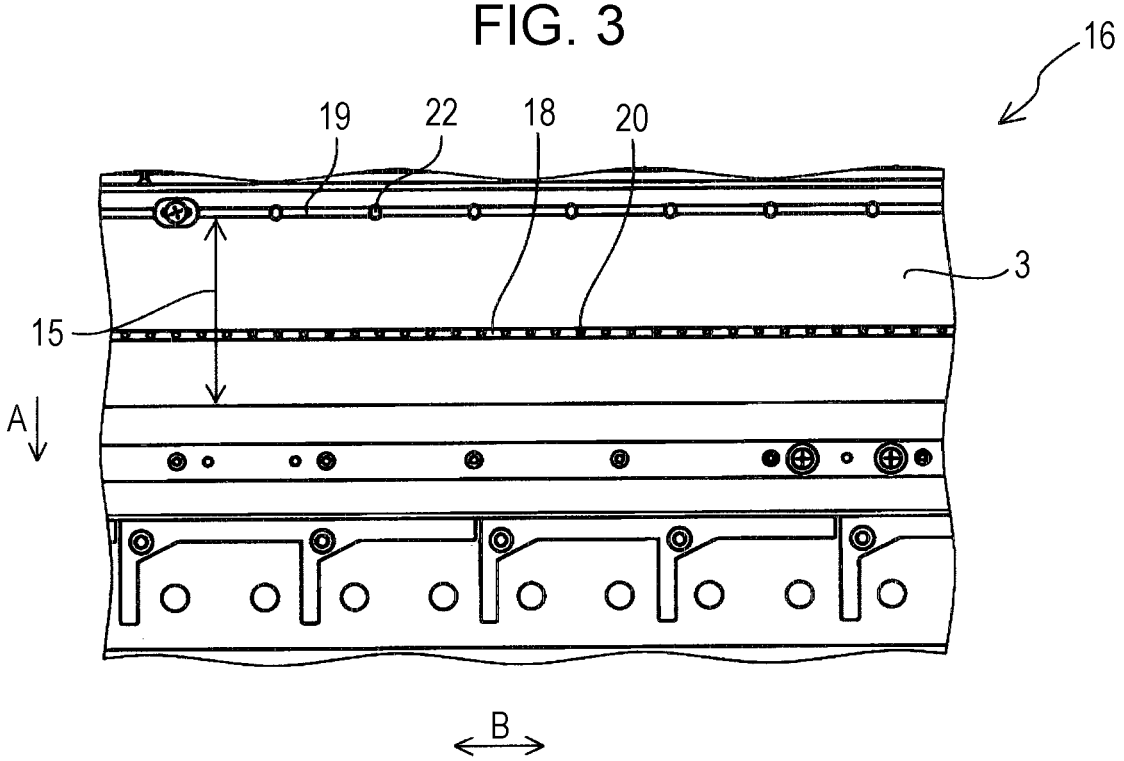
FIG. 3 is a plan view illustrating a main portion of a printing apparatus according to Example 1 of the invention.

Example 1 (FIGS. 1 to 3)

First, an overview of a printing apparatus according to Example 1 of the invention will be described.

FIG. 1 is a schematic side view illustrating a printing apparatus 1 according to this example.

The printing apparatus 1 of this example is provided with a supporting shaft 2 for supporting a roll R1 of a rolled medium M for performing printing. In the printing apparatus 1 of this example, when the medium M is transported in the transporting direction A, the supporting shaft 2 rotates in a rotation direction C. In this example, although a rolled medium M wound so that the printed surface thereof faces outward is used, in a case where a rolled medium M wound so that the printed surface thereof faces inward is used, it is possible to rotate in the reverse direction to the rotation direction C of the supporting shaft 2 and to feed out the roll R1.

In this example, although rolled transfer paper for sublimation transfer is used as the medium M, the type, the shape, or the like of the medium M to be used are not particularly limited.

In addition, the printing apparatus 1 of this example is provided with a supporting portion 17 having a supporting surface 3 for supporting the medium M. The supporting portion 17 and the like constitute a transporting path 16 of the medium M. In addition, the printing apparatus 1 includes a transporting roller pair 5 including a driving roller 7 and a driven roller 8 for transporting the medium M in the transporting direction A in the transporting path 16. The transporting roller pair 5 functions as a transporting unit that transports the medium M in the transporting direction A. The detailed configuration of the supporting portion 17 which is a main portion of the printing apparatus 1 of this example will be described below.

In the printing apparatus 1 of this example, the driving roller 7 is configured with a roller extending in the width direction B intersecting the transporting direction A and a plurality of the driven roller 8 are provided side by side with respect to the driving roller 7 at a position facing the driving roller 7 in the width direction B.

A heater 12 is provided under the supporting portion 17, as a heating unit that can heat the medium M supported by the supporting surface 3. As described above, although the printing apparatus 1 of this example includes the heater that can heat the medium M from a side of the supporting portion 17 as the heating unit, an infrared heater or the like may be provided at a position facing the supporting portion 17 (supporting surface 3).

In addition, the printing apparatus 1 of this example includes a head 4 that serves as a discharge portion for discharging ink as a liquid from the nozzles of the nozzle forming surface provided with a plurality of nozzles in the housing portion 11, and a carriage 6 on which the head 4 is mounted and that can reciprocate in the width direction B.

In the printing apparatus 1 of this example, the transporting direction A in the discharge range 15, which is a position facing the head 4 (nozzle forming surface) on the supporting surface 3, is a direction along a direction Y which is a horizontal direction, the width direction B of the head 4 is a direction along a direction X orthogonal to the direction Y which is a horizontal direction, and the ink discharge direction is a direction (vertically downward direction) along a direction Z which is a vertical direction.

Here, inside the housing portion 11, a frame 14 is formed, and a guide rail 13 attached to the frame 14 and extending in the direction X is formed. The carriage 6 provided with the head 4 is attached to the guide rail 13.

With the configuration described above, the head 4 can print an image by discharging ink from a nozzle (not illustrated) to the medium M to be transported while reciprocating in the width direction B intersecting the transporting direction A. By including the head 4 having such a configuration, the printing apparatus 1 according to this example can forms a desired image on the medium M, by repeating operations that the printing apparatus 1 transports the medium M in the transporting direction A by a predetermined amount (for one pass) and discharges the ink while the head 4 is moved in the width direction B in a state where the medium M is stopped.

Although the printing apparatus 1 of this example is a so-called serial printer that performs printing by alternately repeating transporting of a medium M and scanning (reciprocating movement) of a head 4, the printing apparatus 1 may be a so-called line printer in which continuous printing is performed while continuously transporting the medium M by using a line head in which nozzles are formed in a form of a line along the width direction B of the medium M.

In addition, A take-up shaft 10 that can wind the medium M as a roll R2 is provided on the downstream side of the head 4 in the transporting direction A. In this example, since the medium M is wound so that the printing surface faces outward, the take-up shaft 10 rotates in the rotation direction C when winding up the medium M. On the other hand, in a case of winding up so that the printed surface faces inward, it is possible to wind up by rotating the take-up shaft 10 in the reverse direction to the rotating direction C.

In addition, a tension bar 9 in which a contact portion with the medium M can extend in the width direction B and which can apply a desired tension to the medium M is provided between an end portion on the downstream side of the supporting portion 17 in the transporting direction A and the take-up shaft 10.

Next, the supporting portion 17 which is a main portion of the printing apparatus 1 of this example will be described.

Here, FIGS. 2 and 3 are views illustrating the peripheral portion of the discharge range 15 of the supporting portion 17 which is a main portion of the printing apparatus 1 of this example, and illustrate a state where the medium M is not set in the transporting path 16. In the drawings, FIG. 2 is a perspective view illustrating the periphery of the discharge range 15 of the supporting portion 17 and FIG. 3 is a plan view illustrating the periphery of the discharge range 15 of the supporting portion 17.

As illustrated in FIGS. 2 and 3, the printing apparatus 1 of this example has a supporting surface 3 in which unevenness is not formed in the width direction B at the position of the discharge range 15. In a case where the supporting surface 3 is a supporting surface having unevenness in the width direction B, the medium M is deformed along the unevenness of the supporting surface. By making the supporting surface 3 not to have unevenness in the width direction B, in the printing apparatus 1 of this example, deformation of the medium M can be suppressed along the supporting surface 3 a at the position of the discharge range 15.

In addition, as illustrated in FIGS. 2 and 3, the supporting surface 3 of this example has a groove portion 18 and a groove portion 19 extending in the width direction B. The groove portion 18 and the groove portion 19 are grooves formed on the supporting surface 3. A plurality of suction holes 20 are provided side by side in the groove portion 18 in the width direction B, and a plurality of suction holes 22 are provided side by side in the groove portion 19 in the width direction B. Specifically, the suction hole 20 and the suction hole 22 are provided on the bottom surface of the groove portion 18 and the groove portion 19. However, it suffices if the suction hole is provided inside the groove portion, and the suction hole 20 and the suction hole 22 may be provided on the side surfaces of the groove portion 18 and the groove portion 19.

When the suction holes are provided on the supporting surface 3, if suction holes are formed directly on the surface of the supporting surface 3 rather than inside the groove portions such as the groove portions 18 and the groove portions 19, the supporting surface 3 has unevenness in the width direction B. However, since the suction holes are formed in the groove portions (groove portions 18 and groove portions 19) dug along the width direction B in the supporting surface 3 of this example, the unevenness is not formed on the supporting surface 3 in the width direction B. In other words, the supporting surface 3 of this example is configured to suppress the floatation (deforming) of the medium M by causing the medium M to be sucked to the supporting surface 3 without forming unevenness in the width direction B.

In summary, as illustrated in FIG. 1, the printing apparatus 1 of this example includes a head 4 for discharging ink to the medium M to be transported in the transporting direction A, and a supporting portion 17 having a supporting surface 3 for supporting the medium M. As illustrated in FIGS. 2 and 3, the supporting surface 3 of this example has no unevenness in the width direction B intersecting the transporting direction A, and has a groove portion 18 and a groove portion 19 which are continuously formed along the width direction B, a suction hole 20 for sucking the medium M is formed in the groove portion 18, and a suction hole 22 for sucking the medium M is formed in the groove portion 19.

With such a configuration of the printing apparatus 1 of this example, the medium M can be kept flat by supporting by the supporting surface 3 on which the unevenness is not formed in the width direction B, while the suction holes 20 of the groove portion 18 and the suction holes 22 of the groove portion 19 suppress the floatation of the medium M from the supporting surface 3. Therefore, the printing apparatus 1 of this example is configured so that the floatation of the medium M to be transported from the supporting surface 3 and the decrease in the image quality due to the deformation of the medium M can be suppressed.

In the supporting surface 3 of this example, a plurality of suction holes (suction holes 20 and suction holes 22) along the width direction B are formed in the groove portions (groove portion 18 and groove portion 19) continuously formed along the width direction B. With such a configuration, the medium M can be sucked to the supporting surface 3 particularly efficiently as compared with a configuration in which suction holes are randomly formed on the supporting surface 3, for example.

Both the groove portion 18 and the groove portion 19 of this example are formed continuously from the end portion on one side of the supporting surface 3 to the end portion on the other side of the supporting surface 3 in the width direction B. Therefore, the printing apparatus 1 of this example is particularly reliably configured to suppress the floatation of the medium M from the supporting surface 3.

Additionally, in this example, both lengths of the groove portions 18 and the groove portions 19 in the width direction are longer than the length of a maximum width medium in the width direction B. The maximum width medium is the medium M that has the maximum length in the width direction B among media that can be supported by the supporting portion 17. Therefore, in the printing apparatus 1 of this example, even if any medium M that can be supported by the supporting portion 17 is used, the floatation of the medium M from the supporting surface 3 can be reliably suppressed.

In addition, the supporting surface 3 of this example has a plurality of groove portions called a groove portion 18 and a groove portion 19. In other words, it can be expressed that the supporting surface 3 of this example includes the first groove portion 19 and the second groove portion 18 provided on the downstream side of the first groove portion 19 in the transporting direction A. As described above, since the supporting surface 3 of this example has a plurality of groove portions having a suction hole that can suck the medium M, the floatation of the medium M from the supporting surface 3 can be reliably suppressed.

Here, the suction hole 22 of the first groove portion 19 is intended to stabilize (to suck to supporting surface 3) a posture of the medium M (medium M immediately before being transported to discharge range 15) before printing. In addition, the suction hole 20 of the second groove portion 18 is intended to stabilize (to suck to supporting surface 3) the posture of the medium M (medium M transported to discharge range 15) during printing.

Therefore, as illustrated in FIG. 3, in the supporting surface 3 of this example, the position of the second groove portion 18 in the transporting direction A is closer to the center of the discharge range 15 in the transporting direction A than the position of the first groove portion 19 in the transporting direction A.

The number of suction holes 20 provided in the second groove portion 18 be more than that of the suction holes 22 provided in the first groove portion 19. By making the number of suction holes in the second groove portion 18 more than the number of suction holes in the first groove portion 19, in the supporting surface 3 of this example, the medium M is sucked more strongly in the second groove portion 18 than in the first groove portion 19 (medium M is particularly strongly sucked in the second groove portion 18). In other words, the flow rate of air that can be sucked in the second groove portion 18 is higher than the flow rate of air that can be sucked in the first groove portion 19.

Although the medium M is likely to be bulged and floated due to the landing of the ink discharged from the head 4, in the printing apparatus 1 of this example, the floatation of the medium M from the supporting surface 3 is suppressed with a simple structure and effectively, since the medium M is strongly sucked at the second groove portion 18 near the center of the discharge range 15 in the transporting direction A.

In addition, by making the number of suction holes in the second groove portion 18 more, it is easy to locally suck the medium M. Since the printing apparatus 1 of this example locally sucks the medium M in the second groove portion 18 near the center of the discharge range 15 in the transporting direction A, the floatation of the medium M from the supporting surface 3 can be suppressed easily and effectively.

In particular, as illustrated in FIG. 3, in the supporting surface 3 of this example, the size of the suction hole 20 formed in the second groove portion 18 is smaller than the size of the suction hole 22 formed in the first groove portion 19.

By making the size of the suction hole smaller, it becomes easy to make the number of suction holes more, and it is easy to locally suck the medium M. Since the printing apparatus 1 of this example locally sucks the medium M in the second groove portion 18 near the center of the discharge range 15 in the transporting direction A, the floatation of the medium M from the supporting surface 3 is suppressed easily and effectively.

In this example, the size of the suction hole 20 formed in the second groove portion 18 is made to be smaller than the size of the suction hole 22 formed in the first groove portion 19, whereas, by making the number of suction holes 20 more than the number of suction holes 22, the flow rate of air that can be sucked in the second groove portion 18 further is higher than the flow rate of air that can be sucked in the first groove portion 19. However, according to another configuration, the flow rate of air that can be sucked in the second groove portion 18 may be higher than the flow rate of air that can be sucked in the first groove portion 19. For example, the size of the suction hole 20 formed in the second groove portion 18 further is larger than the size of the suction hole 22 formed in the first groove portion 19, and the number of the suction holes 20 may be equal to the number of the suction holes 22. In addition, the size of the suction hole 20 formed in the second groove portion 18 is equal to the size of the suction hole 22 formed in the first groove portion 19, and the number of the suction holes 20 may be more than the number of the suction holes 22. In other words, in each of the first groove portion 18 and the second groove portion 19, in the flow rate of air that may be comprehensively calculated in consideration of the size and number of the suction holes, and in the flow rate of air which can be sucked, the flow rate of air that can be sucked in the second groove portion 18 may be higher than the flow rate of air that can be sucked in the first groove portion 19.

Here, the position of the first groove portion 19 in the transporting direction A is preferably a position immediately upstream of the discharge range 15. It is possible to stabilize the posture of the medium M immediately before being transported to the discharge range 15. In addition, the position of the second groove portion 18 in the transporting direction A is preferably a position slightly downstream of the center of the discharge range 15 in the transporting direction A. This is because it is possible to stabilize the posture of the medium M (to be reliably sucked to supporting surface 3) in a state where ink is sufficiently landed in the discharge range 15 (in a state where medium M is likely to be deformed) and preferably at a position close to the center of the discharge range 15 in the transporting direction A.

As described above, although the printing apparatus 1 of this example has a configuration including two groove portions having suction holes in the supporting surface 3, the invention is not limited to such a configuration.

The printing apparatus 1 of this example may have only one groove portion or three or more groove portions having a suction hole.

Therefore, Example 2 which is a configuration example including three groove portions having suction holes will be described below.

Figure 4:
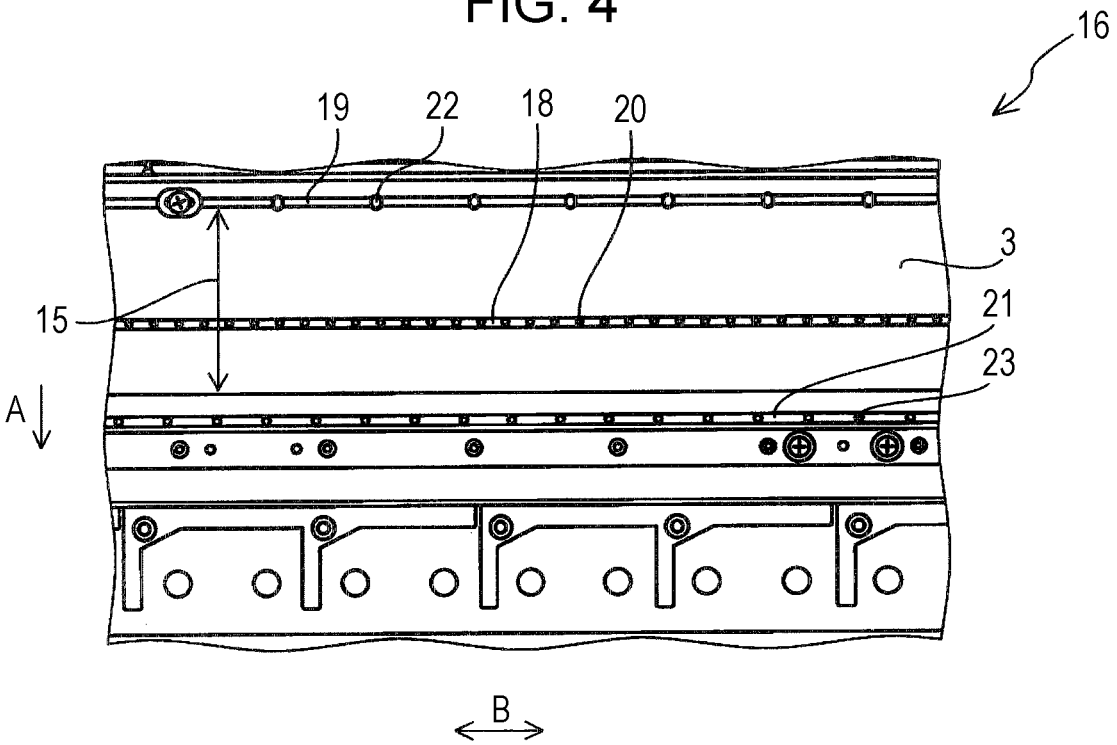
FIG. 4 is a plan view illustrating a main portion of a printing apparatus according to Example 2 of the invention.
Figure 5:
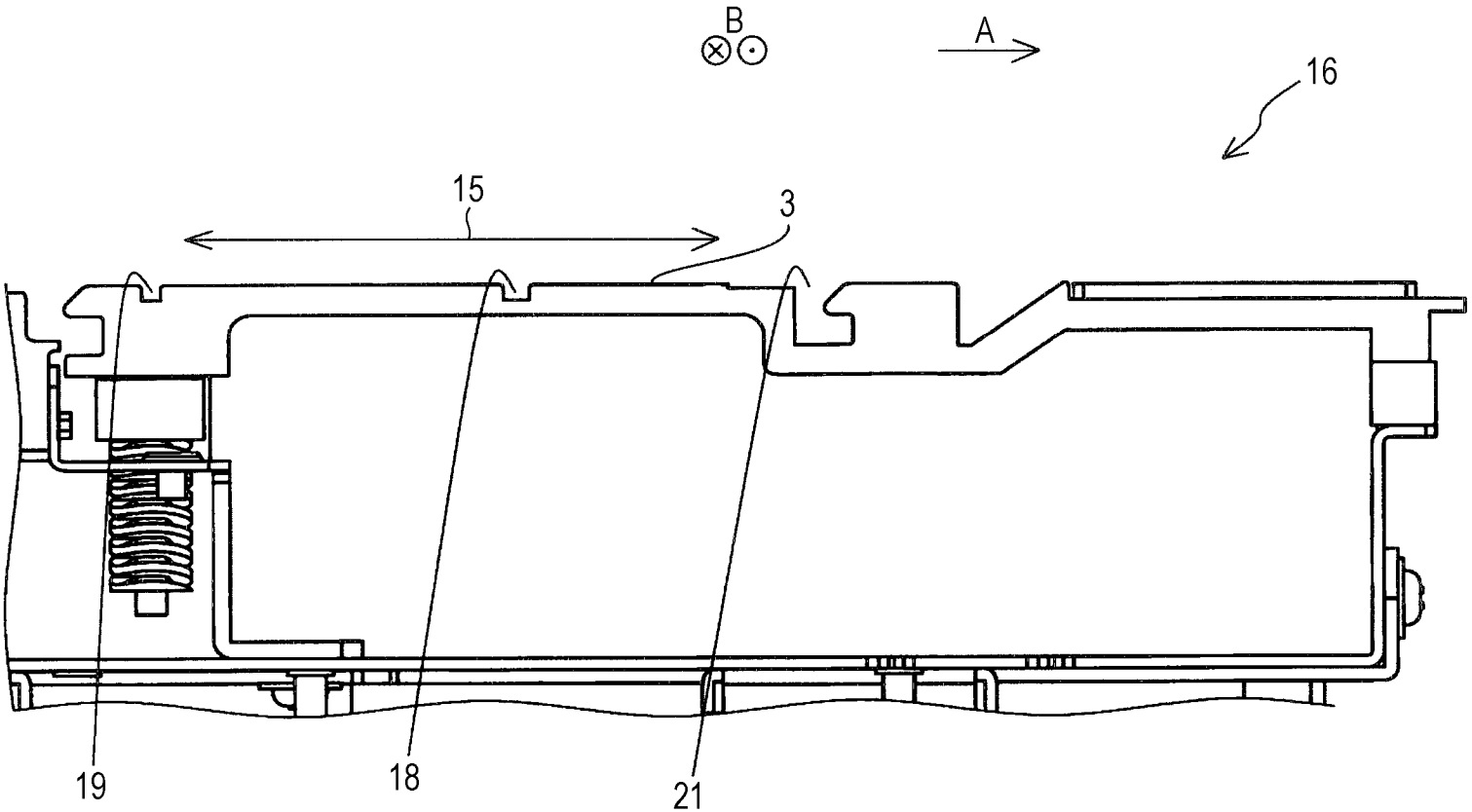
FIG. 5 is a side cross-sectional view illustrating a main portion of a printing apparatus according to Example 2 of the invention.

Example 2 (FIGS. 4 and 5)

FIG. 4 is a plan view illustrating the periphery of the discharge range 15 of the supporting portion 17 which is a main portion of the printing apparatus 1 of this example, illustrates a state where the medium M is not set in the transporting path 16 and corresponds to FIG. 3 of Example 1. In addition, FIG. 5 is a side cross-sectional view illustrating the periphery of the discharge range 15 of the supporting portion 17 which is a main portion of the printing apparatus 1 of this example and illustrates a state where the medium M is not set in the transporting path 16. Constituent members common to those of Example 1 are denoted by the same reference numerals, and a detailed description thereof will be omitted.

In the printing apparatus 1 of this example, the configurations other than the supporting surface 3 are the same configurations as those of the printing apparatus 1 of Example 1.

As illustrated in FIGS. 4 and 5, the supporting surface 3 of this example has a groove portion 21 in addition to the groove portion 18 and the groove portion 19. The groove portion 21 is provided on the downstream side of the groove portion 18 in the transporting direction A. A suction hole 23 for sucking the medium M is formed in the groove portion 21. In summary, the supporting surface 3 of this example can be expressed as including: a first groove portion 19, a second groove portion 18 provided on the downstream side in the transporting direction A of the first groove portion 19, and a third groove portion 21 provided on the downstream side of the second groove portion 18 in the transporting direction A. As described above, since the supporting surface 3 of this example has a plurality of groove portions each having a suction hole that can suck the medium M, the floatation of the medium M from the supporting surface 3 can be reliably suppressed.

Here, like the suction holes 22 of the printing apparatus 1 of Example 1, the suction holes 22 of the first groove portions 19 is intended to stabilize (to be sucked to supporting surface 3) the posture of the medium M (medium M immediately before being transported to discharge range 15) before printing. In addition, like the suction holes 20 of the printing apparatus 1 of Example 1, the suction holes 20 of the second groove portion 18 is intended to stabilize (to be sucked to supporting surface 3) the posture of the medium M (medium M being transported to discharge range 15) during printing.

The suction hole 23 of the third groove portion 21 is intended to stabilize (to be sucked to supporting surface 3) the posture of the medium M (medium M immediately after being transported from discharge range 15) after printing is done.

As illustrated in FIGS. 4 and 5, in the supporting surface 3 of this example, the position of the second groove portion 18 in the transporting direction A is closer to the center of the discharge range 15 in the transporting direction A than the position of the third groove portion 21 in the transporting direction A.

The suction holes 20 provided in the second groove portion 18 be more in number than the suction holes 23 provided in the third groove portion 21. In the supporting surface 3 of this example, by making the number of suction holes in the second groove portion 18 more than the number of suction holes in the third groove portion 21, it is configured so that the medium M is more strongly sucked in the second groove portion 18 than in the third groove portion 21 (medium M is particularly strongly sucked into second groove portion 18). In other words, the flow rate of air that can be sucked in the second groove portion 18 is higher than the flow rate of air that can be sucked in the third groove portion 21.

Although the medium M is likely to be bulged and floated due to the landing of the ink discharged from the head 4, in the printing apparatus 1 of this example, since the medium M is strongly sucked in the second groove portion 18 near the center of the discharge range 15 in the transporting direction A, the floatation of the medium M from the supporting surface 3 is suppressed with a simple structure and effectively.

In addition, by making the number of suction holes in the second groove 18 more, it is easy to locally suck the medium M. Since the printing apparatus 1 according to this example locally sucks the medium M in the second groove portion 18 near the center of the discharge range 15 in the transporting direction A, the floatation of the medium M from the supporting surface 3 is suppressed easily and effectively.

As illustrated in FIG. 4, in the supporting surface 3 of this example, the size of the suction holes 20 formed in the second groove portions 18 is equal to the size of the suction holes 23 formed in the third groove portions 21.

By making the sizes of the suction holes equal to the second groove portion 18 and the third groove portion 21, processing for forming the suction hole becomes easy.

In this example, the size of the suction hole 20 formed in the second groove portion 18 is made equal to the size of the suction hole 23 formed in the third groove portion 21, whereas, by making the number of suction holes 20 more than the number of suction holes 23, the flow rate of air that can be sucked in the second groove portion 18 is higher than the flow rate of air that can be sucked in the third groove portion 21. However, according to another configuration, the flow rate of air that can be sucked in the second groove portion 18 may be configured to be higher than the flow rate of air that can be sucked in the third groove portion 21. This point is the same as the relationship between the first groove portion 19 and the second groove portion 18 described in Example 1.

The invention is not limited to the examples described above, and various modifications are possible within the scope of the invention described in the claims, and needless to say, the various modifications are also included within the scope of the invention.

This application claims priority under 35 U.S.C. § 119 to Japanese Patent Application No. 2017-077026, filed Apr. 7, 2017. The entire disclosure of Japanese Patent Application No. 2017-077026 is hereby incorporated herein by reference.

What is claimed is:

1. A liquid discharge apparatus comprising:

a discharge portion that discharges liquid to a medium to be transported in a transporting direction; and a supporting portion that has a supporting surface supporting the medium, wherein:

the supporting surface facing the discharge portion has at least one groove portion that is continuous along the width direction, a suction hole that is disposed in the at least one groove and configured to suck air from the medium, the supporting surface that does not cover the at least one groove portion has a substantially even surface, the at least one groove portion includes a first groove portion and a second groove portion which is provided on a downstream side of the first groove portion in the transporting direction, the supporting surface supports the medium at least in the discharge range that is a range discharging the liquid by the discharge portion, a position of the second groove portion in the transporting direction is closer to the center of the discharge range in the transporting direction than the position of the first groove portion in the transporting direction is, and the number of the suction holes formed in the second groove portion is more than the number of the suction holes formed in the first groove portion.

2. The liquid discharge apparatus according to claim 1, wherein the length of the at least one groove portion in the width direction is longer than the length of a maximum width medium in the width direction, the maximum width medium is the medium that has the maximum length in the width direction among media that can be supported by the supporting portion.

3. The liquid discharge apparatus according to claim 1, wherein the at least one groove portion is formed continuously from an end portion on one side of the supporting surface to an end portion on the other side of the supporting surface in the width direction.

4. The liquid discharge apparatus according to claim 1, wherein the at least one groove portion further includes a third groove portion which is provided on the downstream side of the second groove portion in the transporting direction.

5. A liquid discharge apparatus comprising:

a discharge portion that discharges liquid to a medium to be transported in a transporting direction; and a supporting portion that has a supporting surface supporting the medium, wherein:

the supporting surface facing the discharge portion has at least one groove portion that is continuous along the width direction, a suction hole that is disposed in the at least one groove and configured to suck air from the medium, the supporting surface that does not cover the at least one groove portion has a substantially even surface, the at least one groove portion includes a first groove portion and a second groove portion which is provided on a downstream side of the first groove portion in the transport direction, the supporting surface supports the medium at least in a discharge range that is a range discharging the liquid by the discharge portion, a position of the second groove portion in the transporting direction is closer to the center of the discharge range in the transporting direction than the position of the first groove portion in the transporting direction is, and wherein a flow rate of air that can be sucked into the second groove portion is higher than a flow rate of air that can be sucked into the first groove portion.

6. A liquid discharge apparatus comprising:

a discharge portion that discharges liquid to a medium to be transported in a transporting direction; and a supporting portion that has a supporting surface supporting the medium, wherein:

the supporting surface facing the discharge portion has at least one groove portion that is continuous along the width direction, a suction hole that is disposed in the at least one groove and configured to suck air from the medium, the supporting surface that does not cover the at least one groove portion has a substantially even surface, the at least one groove portion includes a first groove portion and a second groove portion which is provided on a downstream side of the first groove portion in the transport direction, the supporting surface supports the medium at least in the discharge range which is a range discharging the liquid by the discharge portion, a position of the second groove portion in the transporting direction is closer to the center of the discharge range in the transporting direction than the position of the first groove portion in the transporting direction is, and the size of the suction hole formed in the second groove portion is smaller than the size of the suction hole formed in the first groove portion.

* * * * *